United States Patent [19]

Kohara

[11] 4,111,503

[45] Sep. 5, 1978

[54] SEWING MACHINE CABINET

[75] Inventor: Tadao Kohara, Osaka, Japan

[73] Assignee: Maruzen Sewing Machine Co., Ltd., Moriguchi, Japan

[21] Appl. No.: 807,966

[22] Filed: Jun. 20, 1977

[30] Foreign Application Priority Data

Jul. 2, 1976 [JP] Japan ..... 51-88638
Aug. 12, 1976 [JP] Japan ..... 51-108725

[51] Int. Cl.[2] ..... D05B 75/00

[52] U.S. Cl. ..... 312/27; 312/30; 112/217.1

[58] Field of Search ..... 312/27, 24, 30, 312, 312/208, 306; 112/217.1

[56] References Cited

U.S. PATENT DOCUMENTS

| | | | |
|---|---|---|---|
| 779,569 | 1/1905 | Tetreault | 312/30 |
| 1,940,046 | 12/1933 | Cutler | 312/24 |
| 2,247,380 | 7/1941 | Hohmann | 112/217.1 |
| 2,527,319 | 10/1950 | Marsac | 312/30 |
| 2,874,014 | 2/1959 | Perrinjaquet | 312/30 |
| 2,919,966 | 1/1960 | Preston | 312/27 |
| 3,078,132 | 2/1963 | Stanton et al. | 312/30 |
| 3,788,716 | 1/1974 | Roberts et al. | 312/29 |
| 3,830,554 | 8/1974 | Moussaian et al. | 312/30 |

*Primary Examiner*—Kenneth Downey
*Assistant Examiner*—Victor N. Sakran
*Attorney, Agent, or Firm*—Arnstein, Gluck, Weitzenfeld & Minow

[57] ABSTRACT

A sewing machine cabinet for use with a free-arm type sewing machine in which the sewing machine is maintained at the same level when used either in a free-arm or flat bed mode of operation. The cabinet includes a hinged sewing machine support panel having a pair of depending brackets arranged to cooperate with rotatably notched dogs mounted on walls of the cabinet. The movement of the brackets influences the positions assumed by the dogs so that, in one position of the dogs, the support panel and sewing machine are secured in operating position and, in another position of the dogs, the support panel and sewing machine may be moved downwardly to storage position within the cabinet.

6 Claims, 5 Drawing Figures

SEWING MACHINE CABINET

BACKGROUND OF THE INVENTION

This invention relates to a sewing machine cabinet and more particularly to a cabinet for supporting a convertible free-arm type sewing machine in such manner as to provide one level sewing in both free-arm and flat bed modes of operation of the machine and also, to accommodate the machine in concealed storage position.

It has been found that a sewing machine operator is most comfortable when the bed of the machine is disposed at a certain level above the chair occupied by the operator. In prior art cabinets the level of the bed of the machine was changed for each mode of operation. Thus, operation of the machine in one of the modes always was inconvenient to the operator.

SUMMARY OF THE INVENTION

One of the objects of this invention is the provision of a cabinet in which the sewing machine remains at a fixed level when used either in free-arm or flat bed modes of operation.

Another object of this invention is the provision of a cabinet which provides a work support surface of maximum area when the machine is disposed in a flat bed mode and which provides a maximum clearance for operating the machine in a free-arm mode.

A further object of this invention is the provision in a cabinet of the foregoing character of a novel construction for supporting a sewing machine both in free-arm and flat bed modes of operation, as well as in storage position.

Other and further objects and advantages of this invention will become apparent from the following description when considered in connection with the accompanying drawings.

BRIEF DESCRIPTION OF A PREFERRED EMBODIMENT

Figure 1:
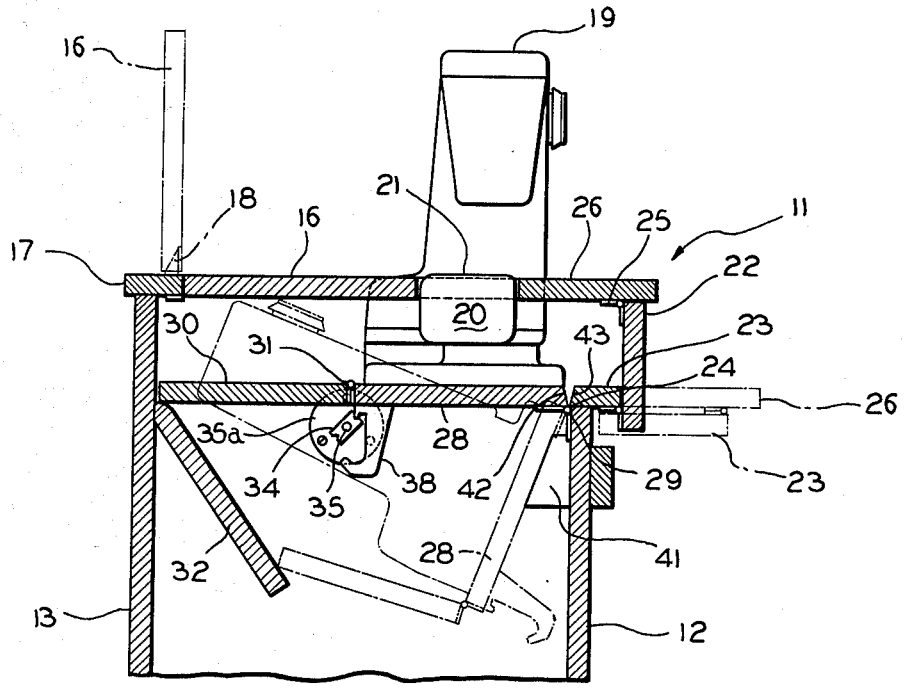
FIG. 1 is a transverse vertical cross sectional view of a preferred embodiment of the invention showing, in solid lines, a sewing machine in flat bed mode of operation, and in broken lines, the sewing machine in storage position.
Figure 2:
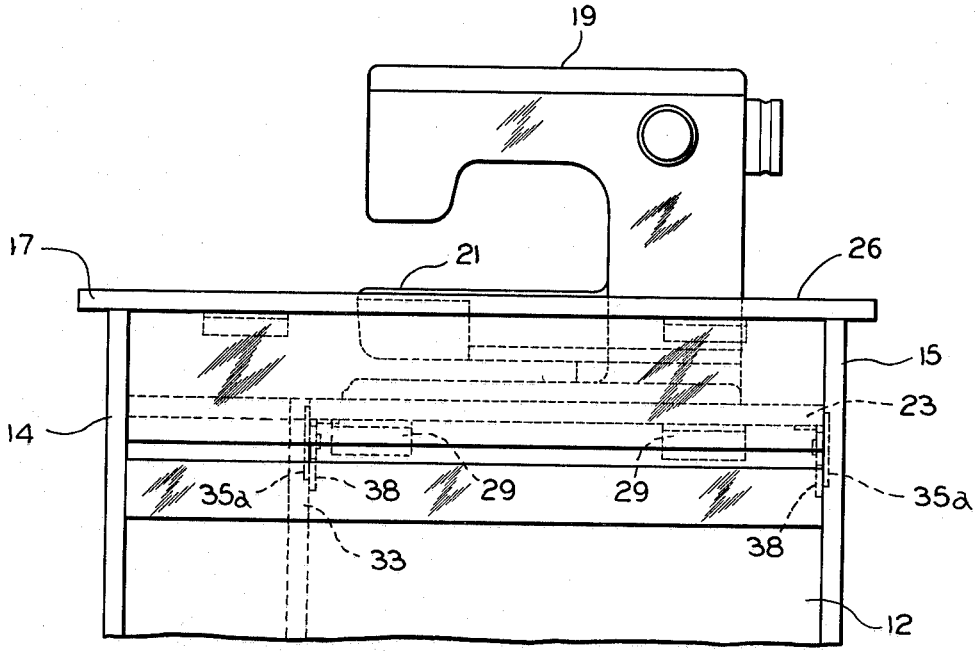
FIG. 2 is a front elevational view of the cabinet illustrated in FIG. 1.
Figure 3:
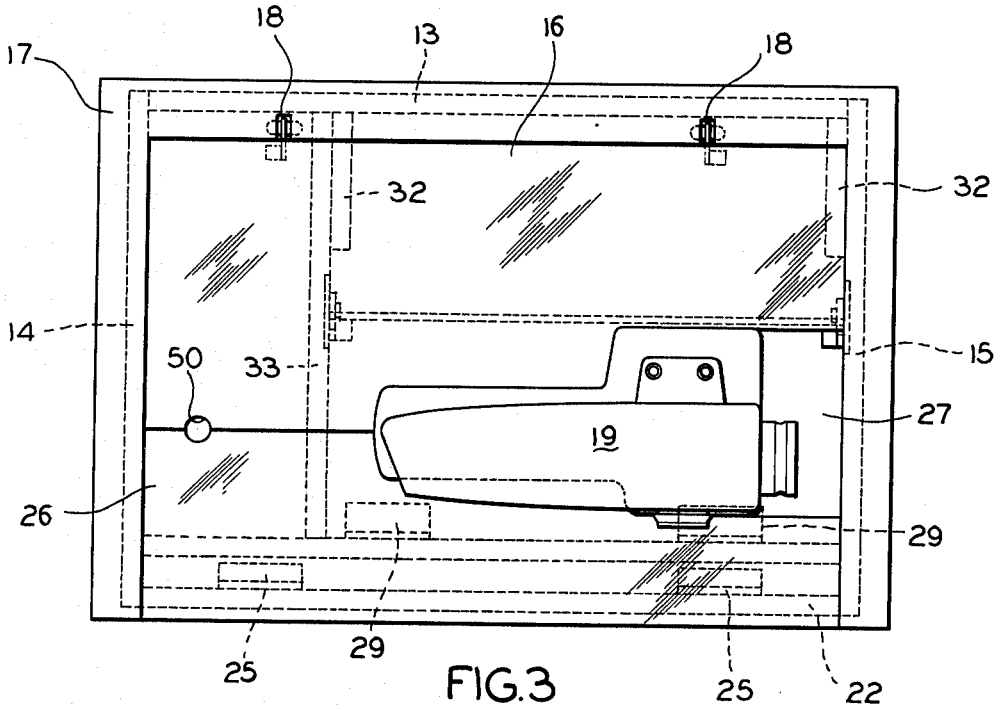
FIG. 3 is a top plan view of the cabinet and sewing machine.

The cabinet constructed in accordance with the present invention and designated generally, by numeral 11, comprises a front wall 12, a rear wall 13 and two side walls 14 and 15. A generally U-shaped planar member 17 is superposed over the top edges of the rear and side walls and has marginal edge portions which extend beyond the planes of said rear and side walls. A top work surface panel 16, shaped substantially as illustrated in plan in FIG. 3, is received within the open space of member 17 and is secured thereto by a pair of hinges 18. In closed position the panel 16 is coplanar with the member 17. As seen in FIG. 1, the front wall 12 is shorter in height than the rear wall 13 and fixed to the top edge of the front wall 12 is a member 23 having a portion extending forwardly beyond the plane of front wall 12. A face member 22 extends fully across the front of the cabinet between the side walls 14 and 15 and is hinged, as at 24, to the member 23. A panel 26, shaped substantially as illustrated in plan in FIG. 3, is hinged as at 25 to the face member 22 and is adapted to be rested on shoulders along the side walls 14 and 15. When so disposed the members 16, 17 and 26 are all coplanar and provide the work support surface for the cabinet. As will be seen in FIG. 1, the panels 16 and 26 and face member 22 may be moved from the solid line positions to the broken line positions illustrated in FIG. 1. A rectangular support panel 28 is hinged, as at 29, to the forward wall 12 and a panel 30 is hinged as at 31 to the distal end of panel 28 and is substantially coextensive in length therewith. An intermediate wall 33 extends between the rear wall 13 and the front wall 12 and has a height substantially equal to that of the front wall 12. It will be noted that the panels 28 and 30 extend between the side wall 15 and the intermediate wall 33, with sufficient clearance being provided so that both panels may move within the space defined by the said walls. Mounted on the walls 15 and 33 are a pair of guide members 32 which are inclined downwardly, as illustrated in FIG. 1. The said guide members are adapted to be engaged by the distal edge of the panel 30 to control the movement of said panel, as will be hereinafter explained.

Each of the intermediate and end walls 33 and 15, respectively, is provided with a circular recess in which is received a circular mounting plate **35*a* which is disposed flush with the surface of a respective wall. Each mounting plate 35*a* has an axial shaft 35 on which is rotatably supported a dog 34. The configuration of each dog 34 is shown clearly in FIGS. 4 and 5, with each dog having opposed 90° V notches 36 and 37**.

Figure 4:
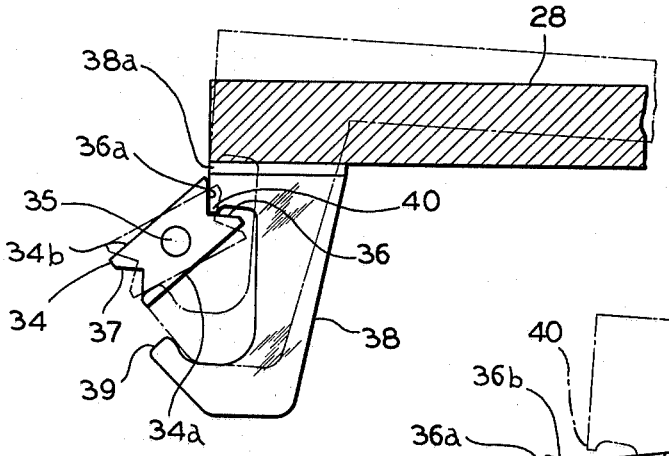
FIG. 4 is a side elevational view, on an enlarged scale, of a structural detail.
Figure 5:
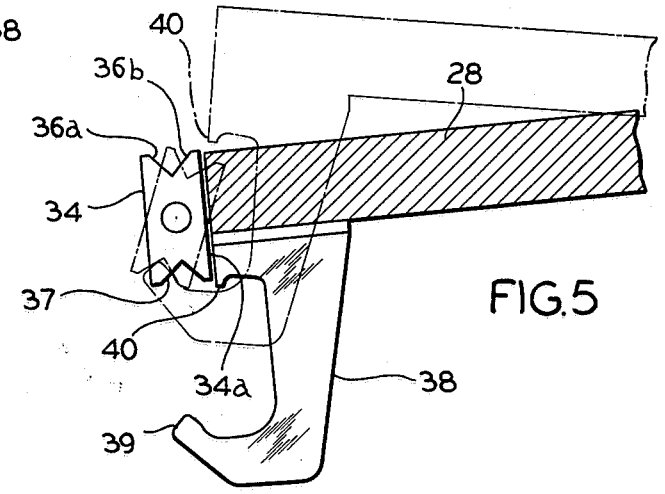
FIG. 5 is a similar view of the same structural detail showing the parts in a different operative relation.

Secured in depending relation to the panel 28 adjacent the distal edge thereof are a pair of spaced brackets 38, shaped substantially as illustrated in FIGS. 4 and 5. It will be noted that each bracket 38 is disposed in registration with a respective dog 34. The lower edge of each bracket 38 terminates in an upwardly inclined finger 39. Each bracket 38 includes in its upper portion a downwardly extending projection 40. Both the finger 39 and projection 40 cooperate with the dog 34, in a manner, as will be hereinafter explained.

Mounted on the panel 28 is a conventional free-arm type sewing machine 19 having a free-arm 20 having a work surface 21. It will be noted that the panels 16 and 26 have cut-out portions configured to freely accommodate the configuration of the base of the machine 19, as seen in FIGS. 1 and 3. An open area 27 may be provided, if desired.

As viewed in FIG. 1, the inner longitudinal edge face 43 of the member 23 is beveled to provide clearance for the movement of panel 28 in a clockwise direction, up to the point of abutment with edge face 42 to permit changing positions of the machine, as will be hereinafter explained. A block 41 having an angular face is secured to the inner surface of the front wall 12.

When the machine is used in a flat bed mode the parts of the cabinet are disposed in the relation illustrated by the solid lines in FIG. 1. In such mode the work surface 21 of the machine as well as the surfaces of the panels 26, 16 and 17 are all disposed in substantially coplanar relationship. The machine 19 is supported on the panel 28 which is disposed in coplanar relationship with the panel 30. In such position, as will be seen by reference to FIG. 4, the projection 40 is engaged in the apex of the upper notch 36, in the relationship illustrated, while the left hand edge 38*a* of the bracket 38 abuts the left hand side 36*a* of the notch 36. Since the load on the support panel 28 is in a downward direction tending to rotate the dog 34 in a clockwise direction, the panel 28 is locked against downward movement whereby the machine 19 is secured in operative position.

In order to operate the machine in a free-arm mode, the panel 16 is rocked upwardly to the broken line position illustrated in FIG. 1, merely by hooking a finger in the aperture 50 and lifting the panel 16 upwardly. The face member 22 is rocked in a clockwise direction, as viewed in FIG. 1, and the panel 26 is then rocked counter-clockwise in order to dispose the same over the member 22 to assume the positions illustrated by the broken lines in FIG. 1. In this mode panel 26, member 43 and panels 28 and 30 are all disposed in coplanar relationship and adequate clearance is provided around the machine 19 for operating the machine in a free-arm mode. It will be noted that in this mode of operation the panels 28 and 30 are still in the relationship illustrated in FIG. 4 and securely locked against inadvertent displacement. While not specifically illustrated in the drawings it will be understood that suitable conventional means may be employed to lock the face member 22 and panel 26 in the positions illustrated in FIG. 1, against inadvertent dislodgment.

In order to move the machine 19 from operative to storage positions, as illustrated by the broken lines in FIG. 1, with the panels 16 and 26 preferably disposed in the broken line positions of FIG. 1, the machine 19 and panel 28 are rocked in a clockwise direction about hinge pivot 43 to the point where the edge faces 42 and 43 are brought into abutment with each other, with the panel 28 and bracket 38 assuming the broken line positions illustrated to FIG. 4. In such position the projection 40 is free of notch 36 and the finger 39 has engaged the side 34*a* of the dog 34 rocking it clockwise to the broken line position illustrated in FIG. 4, so that when the panel 28 is then rocked in a counter-clockwise direction, the projection 40 will engage the side 34*b* of the dog. As the panel 28 continues to be then rocked in a counter-clockwise direction, the projection 40 will effect rotation of the dog 34 approximately one-half revolution to the position illustrated by the solid lines in FIG. 5 wherein the longitudinal edge 34*a* of the dog 34 is parallel to the left hand edge of bracket 38 and panel 28, as viewed in FIG. 5. Thus, clearance is provided for continued movement of panel 28 in a counter-clockwise direction to the broken line position illustrated in FIG. 1. It will be noted that the panel 30 will engage the guide members 32, as the panel moves from solid to broken line position. In the final storage position, panel 28 is in abutment with the angular face of block 41. Finally, the panels 16 and 26 are moved to the solid line positions illustrated in FIG. 1 and, if desired, a suitable cover member, not shown, may be applied over the top surfaces of the panels 16 and 26 to conceal the cut-outs of said panels.

In order to move the machine to operative position, the panels 16 and 26 are moved to the broken line positions illustrated in FIG. 1 and the machine 19 and panel 28 are rocked in a clockwise direction, as viewed in FIG. 1, to the position where the edges 42 and 43 are in abutment and the panel 28 and bracket 38 are caused to assume the position illustrated by the broken lines in FIG. 5. It will be noted that as the finger 39 is caused to move upwardly it will engage in the lower notch 37 causing the dog 34 to rock clockwise, substantially to the position illustrated by the broken lines in FIG. 5. The notch 36 now is in position to be engaged by the projection 40 which engages the right hand side wall 36*b* of the notch and further rocks the dog 34 clockwise so that when the panel 28 assumes the horizontal position illustrated by the solid lines in FIG. 4 the projection 40 and dog 34 are disposed in the relationship illustrated in FIG. 4 wherein the parts are locked in position against inadvertent dislodgment, as hereinabove described.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In a sewing machine cabinet a frame including front and rear walls and a pair of opposite side walls, a sewing machine support panel hinged to said front wall and adapted to pivot about the hinge axis from a substantially vertically inclined stored position within the cabinet to a substantially horizontally inclined operative position, mechanism for supporting and locking the support panel in the operative position and for releasing the same for pivoting into stored position, said mechanism comprising a pair of brackets secured in depending relation to said support panel, each bracket being located adjacent a respective side wall, each bracket having opposed upper and lower projections arranged in spaced confronting relation to each other, a roatable dog mounted on each side wall in planar registration with a respective bracket, each dog being substantially rectangular in shape and having a notch in each end edge, said upper projection when the support panel is in secured operative position being engaged in an upwardly disposed notch with a side of said notch being disposed in over center position and bearing against an outer edge of said upper projection, said lower projection when said support panel is rocked upwardly from the operative position engaging a lower edge portion of said dog to rock said dog to a position whereby upon the downward movement of said support panel the upper projection will rock the dog so that it assumes a position out of the path of movement of the upper projection thereby freeing the support panel for movement to a stored position within the cabinet.

2. The invention as defined in claim 1 in which when the support panel is rocked from storage position in an upward direction and beyond the operative position, the lower projection engages the dog to rock it into the path of movement of the upper projection so that when the support panel again is moved downwardly the upper projection will engage in the upwardly disposed notch to secure the support panel in operative position.

3. The invention as defined in claim 1 in which the sides of each notch form a right angle.

4. The invention as defined in claim 3 in which each upper projection includes a right angle corner arranged to be received in a cooperating right angle notch to secure the support panel against downward movement.

5. The invention as defined in claim 1 in which the bracket has a generally C-shaped configuration with the projections comprising the terminal portions of the configuration.

6. The invention as defined in claim 1 including a free-arm type sewing machine mounted on said support panel and having a work surface above said support panel and further including a pair of work surface panels hinged to said frame and arranged to be selectively disposed in a horizontal plane above the support panel and substantially coplanar with the work surface of the sewing machine whereby the sewing machine may be used in a free-arm or flat bed mode of operation.

* * * * *